United States Patent [19]

Gat et al.

[11] Patent Number: 4,764,143

[45] Date of Patent: Aug. 16, 1988

[54] ASSEMBLY TOYS FOR JOINING CYLINDRICAL OBJECTS

[75] Inventors: Asher Gat, Givat Shmuel; Daniel Low, Moliver 24, Rishon LeZion, both of Israel

[73] Assignee: Daniel Low, Rishon Le-Zion, Israel

[21] Appl. No.: 839,624

[22] Filed: Mar. 14, 1986

[30] Foreign Application Priority Data

Sep. 19, 1985 [IL] Israel ..... 76426

[51] Int. Cl.[4] ..... A63H 33/12; A63H 33/06; A63H 33/08

[52] U.S. Cl. ..... 446/102; 446/120; 446/127

[58] Field of Search ..... 446/102, 77, 104, 107, 446/108, 109, 119, 120, 127, 128, 124; 211/189

[56] References Cited

U.S. PATENT DOCUMENTS

| | | | |
|---|---|---|---|
| D. 214,745 | 7/1969 | Walker | 447/127 X |
| 1,009,468 | 11/1911 | Burrowes | 446/115 |
| 1,084,597 | 1/1914 | Anft | 446/127 |
| 1,130,324 | 3/1915 | Owen | 446/127 |
| 1,294,446 | 2/1919 | Greenstreet | 446/127 X |
| 2,406,759 | 9/1946 | Glukes | 446/127 |
| 2,414,716 | 1/1947 | Carson | 446/124 X |
| 2,472,363 | 6/1949 | Blackington | 446/127 |
| 2,542,948 | 2/1951 | Scherf | 434/259 |
| 2,800,743 | 7/1957 | Meehan et al. | 446/127 |
| 3,221,439 | 12/1965 | Schaper | 446/120 |
| 3,422,564 | 1/1969 | Izumi | 446/74 |
| 3,479,662 | 11/1969 | Fischer | 446/77 |
| 3,591,973 | 7/1971 | Fischer | 446/127 |
| 3,597,874 | 8/1971 | Ogsbury et al. | 446/120 X |
| 3,640,018 | 2/1972 | Light | 446/77 |
| 3,648,404 | 3/1972 | Ogsbury et al. | 446/102 X |
| 3,713,247 | 1/1973 | Parrilla | 446/71 |
| 3,815,281 | 6/1974 | Kander | 446/77 |
| 3,877,170 | 4/1975 | Bakker | 446/124 |
| 3,924,738 | 12/1975 | Poupitch | 206/150 |
| 4,035,947 | 7/1977 | Burge | 446/127 |
| 4,170,082 | 10/1979 | Freedman | 446/77 X |
| 4,474,491 | 10/1984 | Ferarelli | 403/305 |
| 4,548,590 | 10/1985 | Green | 446/120 |

FOREIGN PATENT DOCUMENTS

| | | | |
|---|---|---|---|
| 894241 | 2/1983 | Belgium . | |
| 1004980 | 3/1957 | Fed. Rep. of Germany . | |
| 1805769 | 8/1970 | Fed. Rep. of Germany | 446/127 |
| 2078881 | 11/1971 | France . | |
| 65914 | 12/1985 | Israel . | |
| 408134 | 12/1975 | Sweden . | |
| 2066091 | 7/1981 | United Kingdom . | |
| 2087743 | 6/1982 | United Kingdom | 446/102 |
| 2171022 | 8/1986 | United Kingdom | 446/93 |

*Primary Examiner*—Robert A. Hafer
*Assistant Examiner*—D. Neal Muir
*Attorney, Agent, or Firm*—Cushman, Darby & Cushman

[57] ABSTRACT

An assembly toy comprising a plurality of devices for removably connecting a plurality of cylindrical objects, each device including apparatus for removably coupling thereof to another such device or to an intermediate coupling device at a wide variety of angles.

7 Claims, 24 Drawing Sheets

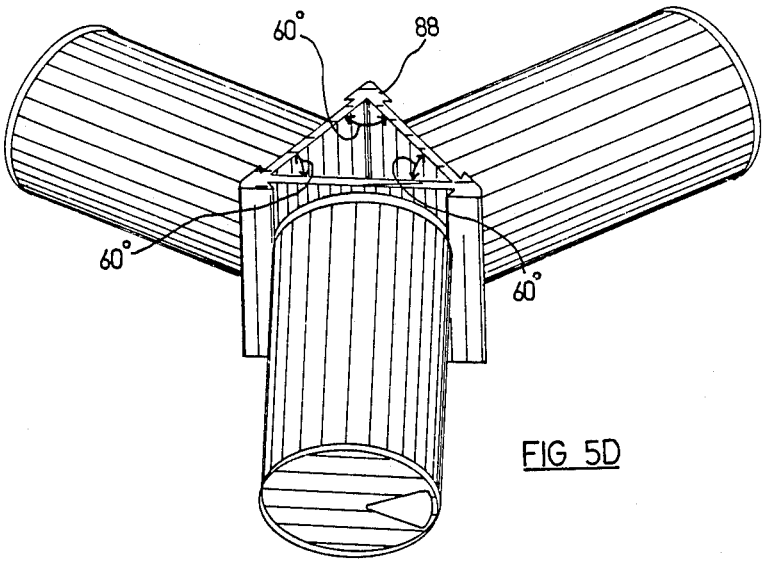
FIG 5D
FIG 6C
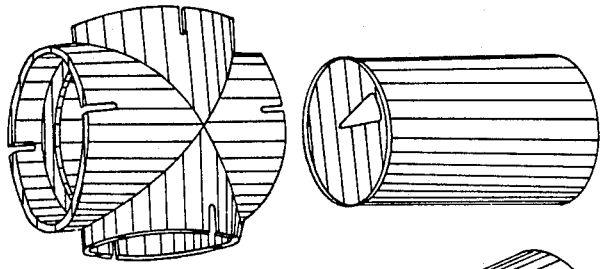
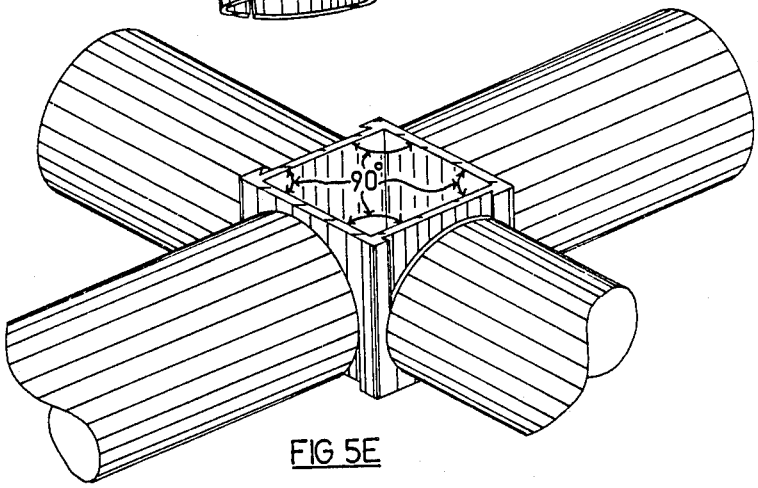
FIG 5E

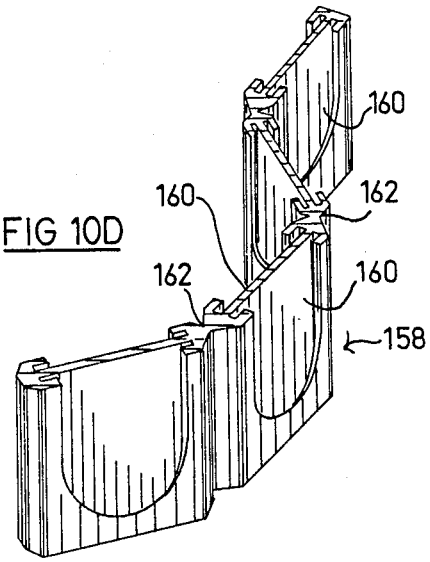
FIG 10D
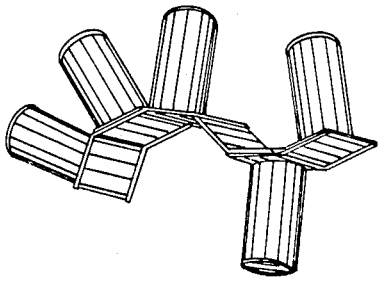
FIG 10F
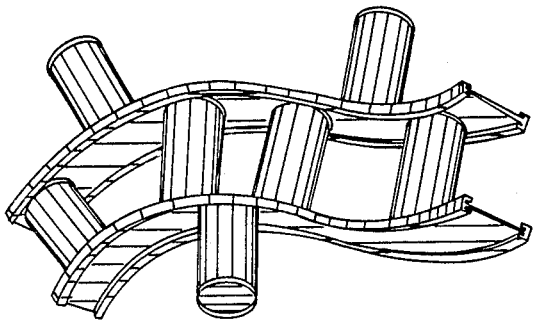
FIG 10E
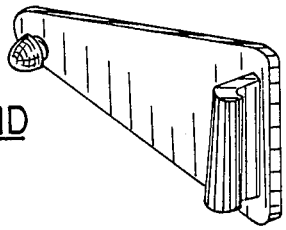
FIG 11D
FIG 11B
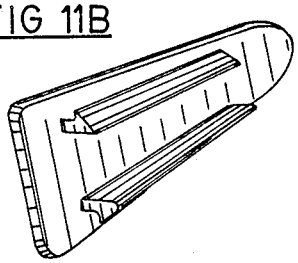
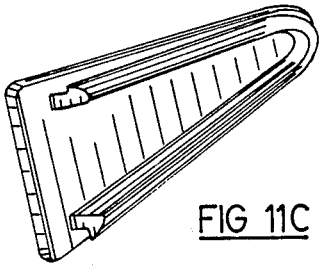
FIG 11C

ASSEMBLY TOYS FOR JOINING CYLINDRICAL OBJECTS

FIELD OF THE INVENTION

The present invention relates to assembly toys generally and more particularly to toys for joining cylindrical objects.

BACKGROUND OF THE INVENTION

In recent years toys have become increasingly more expensive and more sophisticated. In the view of some observers, the enjoyment derived by children from the toys and the play life time of the toys has decreased as the sophistication has increased.

Accordingly, attempts have been made to design toys which employ common household objects. For example wheeled toy trains have been made using aluminum drink cans for bodies, ice cream sticks have been designed as building elements, and so forth.

SUMMARY OF THE INVENTION

The present invention seeks to provide an assembly toy which employs as its principal element a common household object which might otherwise be discarded after use.

There is thus provided in accordance with a preferred embodiment of the present invention, an assembly toy comprising a plurality of devices for removably connecting a plurality of cylindrical objects, each device including means for removably coupling thereof to another such device or to an intermediate coupling device.

Additionally in accordance with an embodiment of the present invention, the means for removably coupling comprises at least one of first and second mateable engagement elements.

In accordance with a predetermined embodiment of the invention there are provided both first and second mateable engagment elements.

Further in accordance with an embodiment of the invention, there are provided on each device mateable engagement elements of at least first and second types, typically providing a fixed rotational orientation and a selectable rotational orientation.

Additionally in accordance with an embodiment of the invention, the means for removably coupling comprises hinge means.

Further in accordance with an embodiment of the present invention, the means for removably coupling comprises snap fitting means.

Additionally in accordance with an embodiment of the invention, the device provides orientation of the cylindrical objects in predetermined relative axial orientations. Alternatively, in accordance with an alternative embodiment of the invention, the device provides orientation of the cylindrical objects in selectable relative axial orientations.

In accordance with one embodiment of the present invention, the device provides axial friction fit engagement with the cylindrical elements. According to an alternative embodiment of the invention, transverse sliding friction fit engagement is provided. According to a further alternative embodiment of the invention, snap fit engagement is provided.

Additionally in accordance with an embodiment of the invention, the device is configured to define a structural element. The structural element may be employed as an element of furniture such as a shelf assembly, a table, or the like.

BRIEF DESCRIPTION OF THE DRAWINGS

The present invention will be understood and appreciated more fully from the following detailed description taken in conjunction with the drawings in which:

FIGS. 5A, 5B, 5C, 5D, 5E, and 5F are pictorial illustrations of coupling devices of the same general type as those illustrated in FIGS. 4A–4D;

FIGS. 6A, 6B, 6C, 6D and 6E are pictorial illustrations of coupling devices of an alternative design;

FIGS. 10A, 10B, 10C, 10D, 10E, and 10F are pictorial illustrations of variations of flexible coupling devices constructed and operative in accordance with an embodiment of the invention;

FIGS. 11A, 11B, 11C, 11D, and 11E illustrate a plurality of variations of cap elements suitable for sealing the openings in used drink cans;

DETAILED DESCRIPTION OF THE INVENTION

Figure 1B:
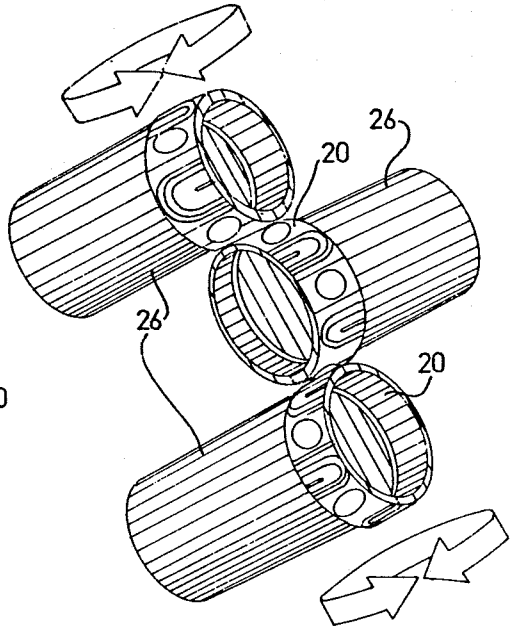
FIG. 1B is a pictorial illustration of a plurality of devices of the type illustrated in FIG. 1A in coupling engagement.
Figure 1A:
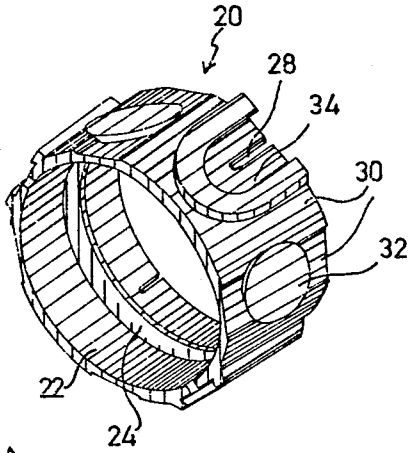
FIG. 1A is a pictorial illustration of a device for connecting a pair of cylindrical objects which is constructed and operative in accordance with a preferred embodiment of the invention.

Reference is now made to FIGS. 1A and 1B which illustrate a device for coupling a pair of cylindrical objects, constructed and operative in accordance with a preferred embodiment of the present invention. The device, indicated generally by reference numeral 20, is generally of ring shape, having an inner surface 22 of overall circular cylindrical configuration which is divided by a divider 24 into two halves, each configured for friction engagement with the end portion of a conventional cylindrical drink can 26. Axial slots 28 are formed in the ring shaped device 20 to provide the needed flexibility for the friction engagement.

The outer surface of device 20 is formed with a plurality of facets 30, typically eight in numer. On alternating facets there are provided male engagement elements in the form of generally circular protrusions 32 and on the adjacent alternating facets there are provided female engagement elements in the form of corresponding sockets 34. It is noted that axial slots 28 are typically located at the center of sockets 34 in order to provide them with desired flexibility.

It is a particular feature of the configuration of the protrusions 32 and the sockets 34 in the embodiment of FIGS. 1A and 1B that any desired azimuthal positioning of joined devices 20 may be realized. FIG. 1B illustrates one example of joined devices 20, it being understood that additional cylindrical cans 26, may, if desired, be mounted on each device.

Figure 2A:
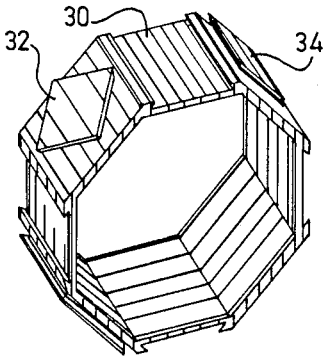
FIG. 2A is a pictorial illustration of a device for connecting a pair of cylindrical objects which is constructed and operative in accordance with another preferred embodiment of the invention.
Figure 2B:
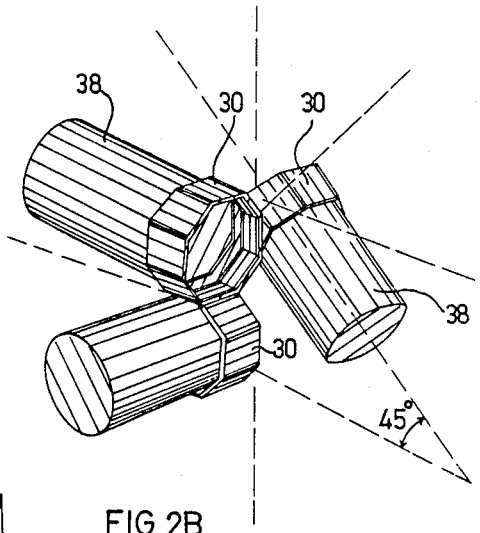
FIG. 2B is a pictorial illustration of a plurality of devices of the type illustrated in FIG. 2A in coupling engagement.

Reference is now made to FIGS. 2A and 2B, which illustrate another variety of devices 30, similar to devices 20 described hereinabove in connection with FIGS. 1A and 1B, but have different types of protrusions. In the illustrated embodiment of FIGS. 2A and 2B, the protrusions 32 are rectangular, and more specifically square, and the sockets 34 are are arranged to accept the protrusions only with their sides parallel to the sides of the protrusions. Thus, the azimuthal arrangement between engaged devices 30, is limited to predetermined angles. In the illustrated exemplary embodiment, the protrusions and the sockets are offset in their respective planes by 45 degrees.

The resulting joined configuration of a plurality of devices 30 is illustrated in FIG. 2B, where it is seen that the angular restriction as to azimuth defines a required angular relationship between the respective axes of the cylindrical cans 38 which are mounted therein, thus providing a relatively rigid structure as compared with the structure illustrated in FIG. 1B.

Reference is now made to FIGS. 3A–3D which illustrate a preferred embodiment of the invention which combines the features of the two embodiments described hereinabove. There is illustrated in FIGS. 3A–3D a device 40, having eight facets 42, each separated by 45 degrees from the facets adjacent thereto. On four alternating facets there are formed universal sockets 44 arranged to receive either circular or square protrusions. There are provided two such circular protrusions 46 and two square protrusions 48.

It is appreciated that the devices of FIGS. 3A–3D provide an option two types of coupling free-azimuth coupling employing the circular protrusions 46, or a fixed-azimuth coupling employing the square protrusions 48. This arrangement provides ease of construction, permitting the construction of a relatively rigid combination of joined devices 40, without unduly limiting the configuration.

Figure 4D:
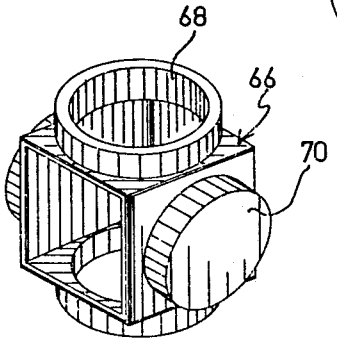
FIGS. 4C, 4D, and 4E are pictorial illustrations of alternative versions of devices of the same general type as that illustrated in FIG. 4A.
Figure 4E:
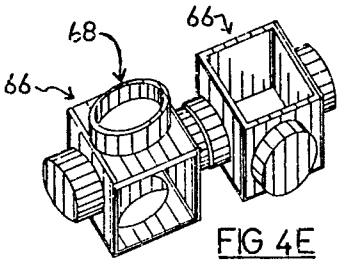
Figure 4C:
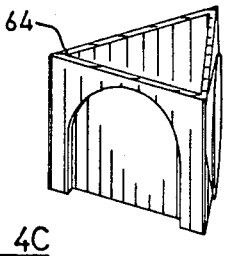
Figure 4A:
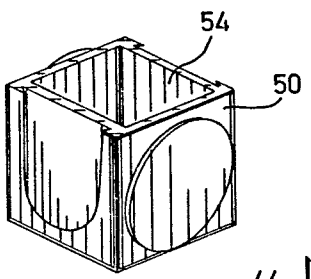
FIG. 4A is a pictorial illustration of a device for connecting a plurality of cylindrical objects which is constructed and operative in accordance with still another embodiment of the invention.
Figure 4B:
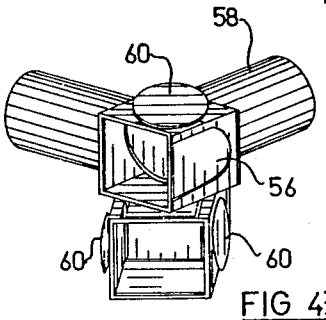
FIG. 4B is a pictorial illustration of a plurality of devices of the type illustrated in FIG. 4A in coupling engagement.
Figure 5B:
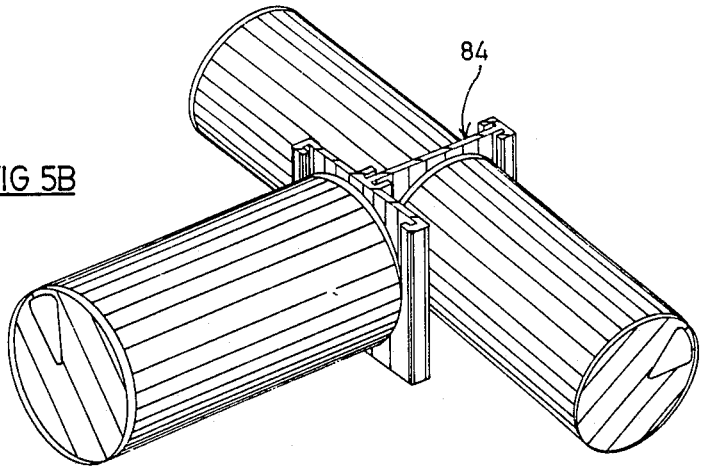

Reference is now made to FIGS. 4A and 4B, which illustrate another type of coupling element 50 which is arranged for selectable end engagement with an undercut edge portion of a conventional drink can. Element 50 is typically of rectangular configuration as shown in FIGS. 4A and 4B and may be formed with a central cavity 54 which is sized to accomodate a conventional cylindrical drink can.

Element 50 is typically formed with two sockets 56 which are configured to removably but securely engage the undercut top edge portion of a conventional drink can 58 and two protrusions 60 which conform to the configuration of the undercut top edge portion of a conventional drink can 58 in that they can also be removably but securely retained in sockets 56.

FIG. 4C illustrates an element 64 having the same type of protrusion and socket arrangement as elements 50 but having a triangular configuration.

FIG. 4D illustrates a device 66, which represents another variation of the device 50 shown in FIGS. 4A and 4B. Here there are provided sockets 68 which are arranged to receive therewithin the butt ends of cylinders such as conventional drink cans. There are also provided protrusions 70 which confirm to the configurations and sizes of the butt ends, enabling the protrusions 70 to be securely and removably seated in the sockets 68, as illustrated in FIG. 4E.

Figure 5A:
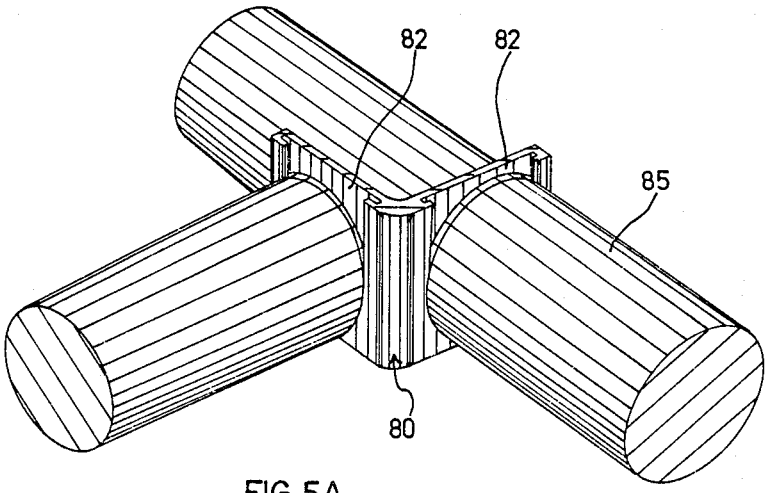
Figure 3A:
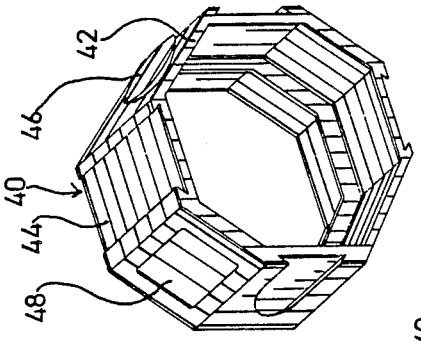
FIG. 3A is a pictorial illustration of a device for connecting a pair of cylindrical objects which is constructed and operative in accordance with still another preferred embodiment of the invention.
Figure 3C:
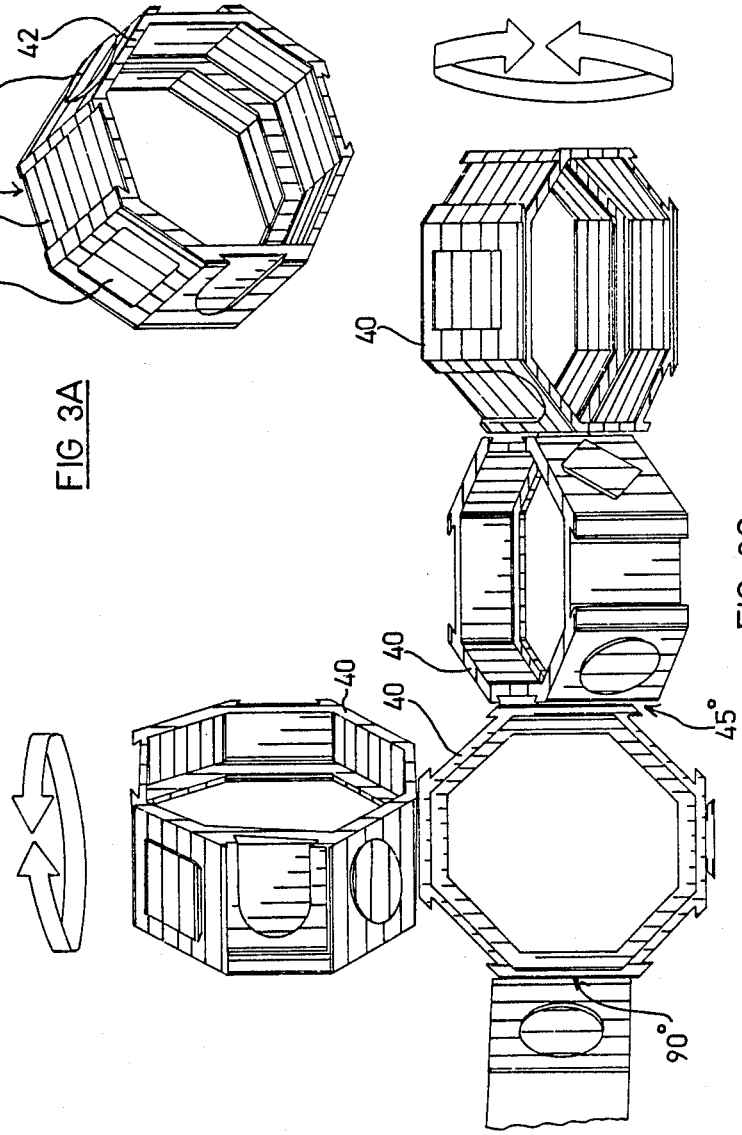
FIG. 3C is a pictorial illustration of a plurality of devices of the type illustrated in FIGS. 3A, 3B, and 3D in coupling engagement.
Figure 3D:
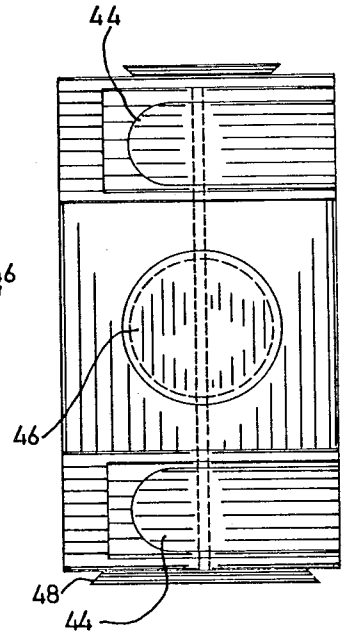
FIG. 3D is a side view illustration of the device of FIG. 3A.
Figure 3B:
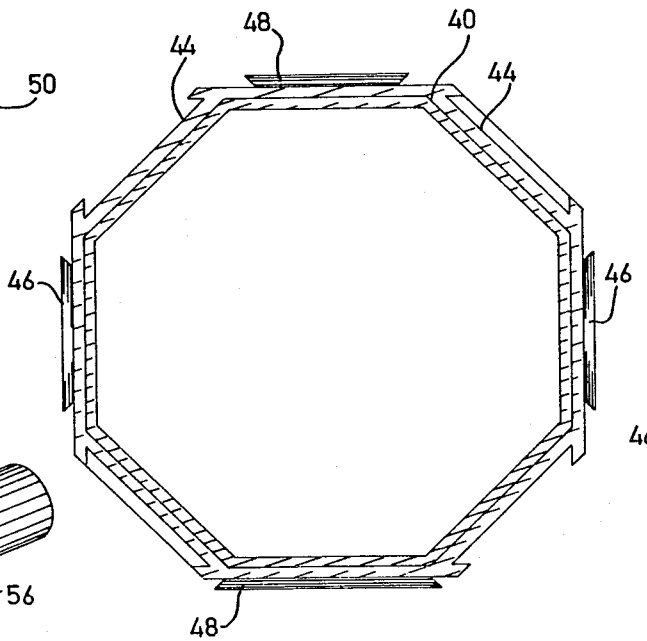
FIG. 3B is an end view illustration of the device of FIG. 3A.
Figure 5C:
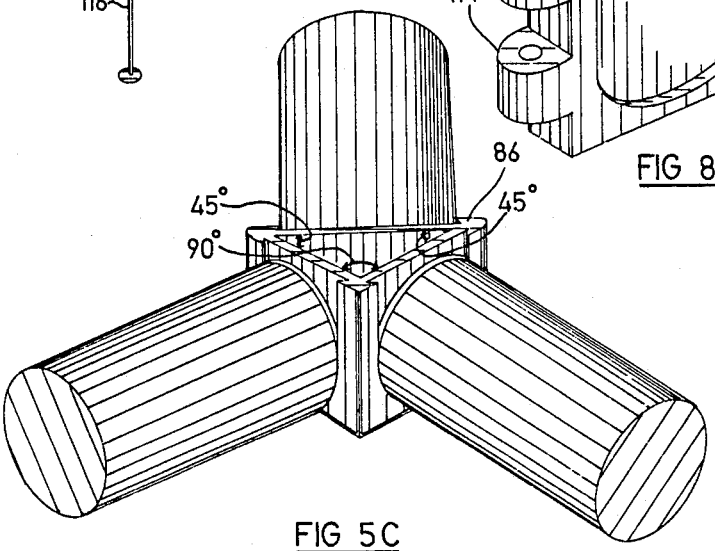
Figure 5F:
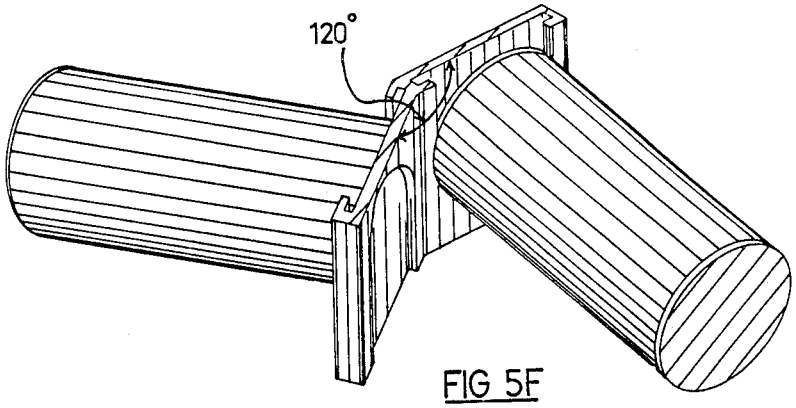

Reference is now made to FIGS. 5A–5F which illustrate a relatively thin type of connector device. In FIG. 5A, the connector device 80 defines three sockets 82, each of which is arranged to removably engage the undercut edge portion of a drink can 85, as shown. Another variation of this connector device is illustrated at reference numeral 84 in FIG. 5B. Triangular configuration connectors 86 and 88 respectively are illustrated in FIGS. 5C and 5D. In FIGS. 5C and 5D, the connectors are angularly separated by the angles indicated. FIGS. 5E and 5F illustrate other types of connectors having the angular separations indicated thereon.

Figure 6B:
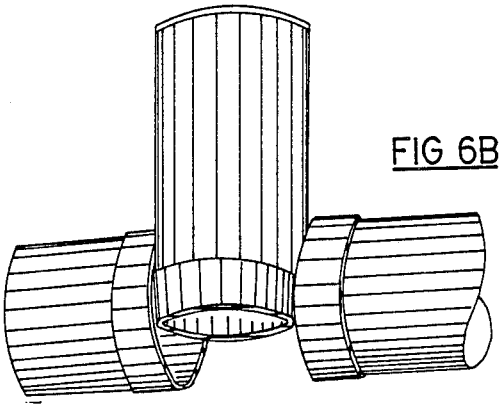
Figure 6A:
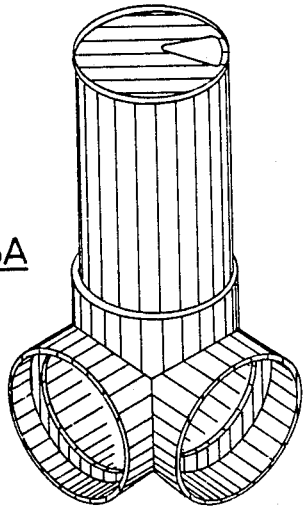
Figure 6D:
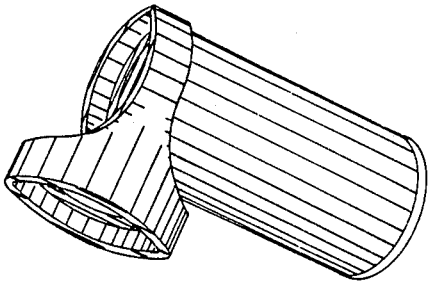
Figure 6E:
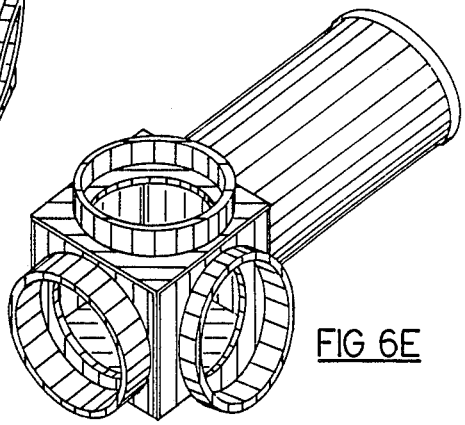

FIGS. 6A–6E illustrate a different configuration of connector defining female sockets for engagement with cylindrical objects such as drink cans. In FIGS. 6A and 6B there are shown two variations of triple socket configurations. FIG. 6C illustrates a quadruple socket coupling device. In FIG. 6D there is shown a coupling device which joins two cylinders axially and a third cylinder at right angles thereto. FIG. 6E shows a coupling device providing up to six female sockets for cylindrical objects such as drink cans.

Figure 7B:
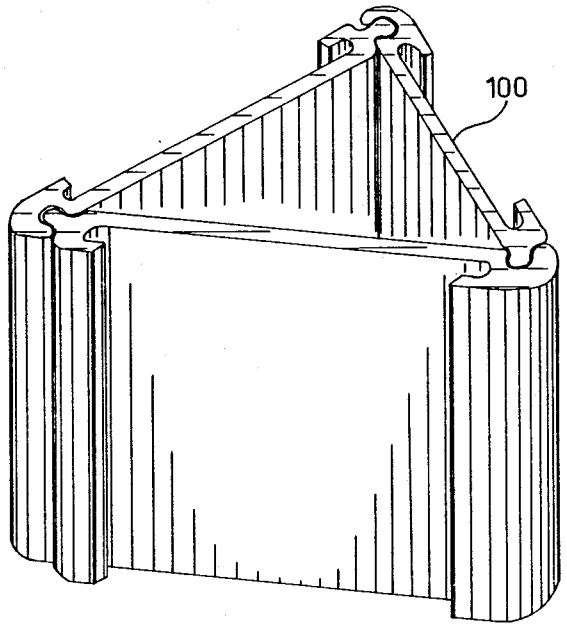
FIGS. 7A, 7B and 7C are pictorial illustrations of coupling devices of still another alternative design providing snap fit edge coupling.
Figure 7A:
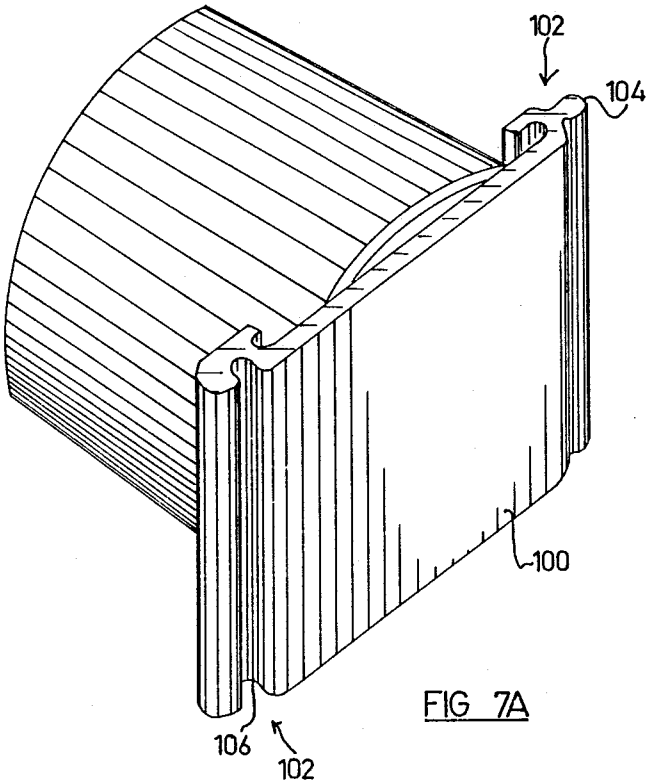
Figure 7C:
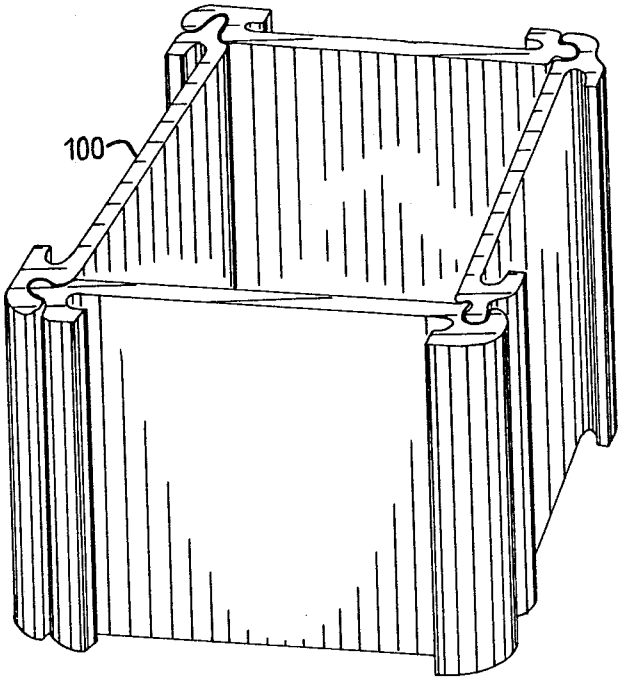

FIGS. 7A–7C illustrate a one sided coupling element 100 which is formed with a snap fit hinge 102 for engagement with other elements having similar hinges. The male portion of the hinge is illustrated at 104, while the female portion of the hinge is illustrated at 106. Three sided and four sided configurations of elements 100 are illustrated in FIGS. 7B and 7C respectively.

Figure 8C:
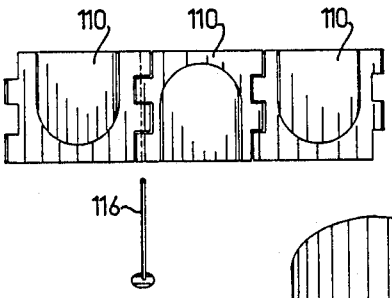
FIGS. 8A, 8B and 8C are pictorial illustrations of coupling devices of still another alternative design providing hinged edge coupling.
Figure 8A:
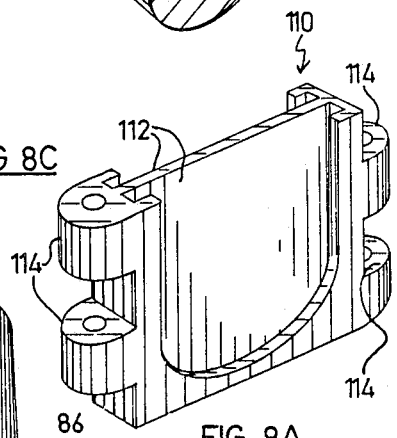
Figure 8B:
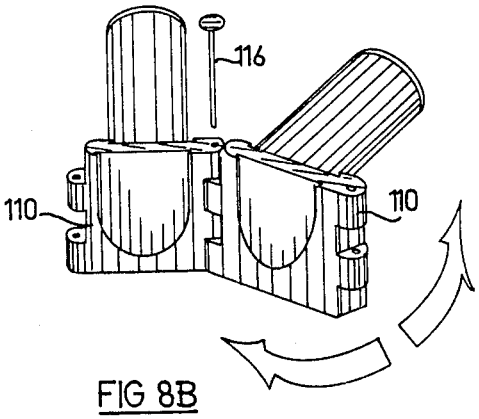

FIGS. 8A–8C illustrate an alternative embodiment of the present invention which employs a different type of hinged coupling. FIG. 8A shows an individual element 110 having back to back female sockets 112 arranged to removably receive the undercut edge of a soft drink can. Hinge elements 114 are arranged along opposite sides of the element 110 and are arranged for selectable pivotable engagement with like elements in the same orientation, as shown in FIG. 8B, or in upside down orientation, as shown in FIG. 8C. Conventional hinge pins 116 secure adjacent elements in pivotable hinged engagement.

Figure 9A:
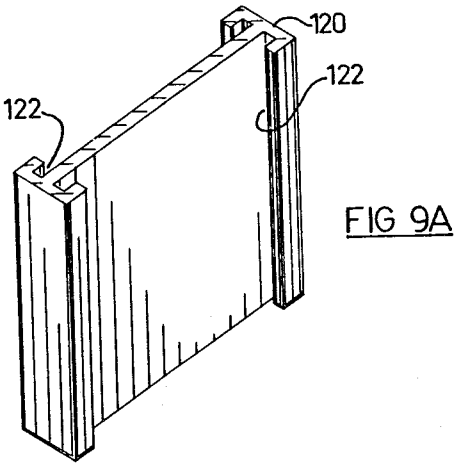
FIGS. 9A, 9B, 9C and 9D are pictorial illustrations of four variations of axial coupling devices constructed and operative in accordance with an embodiment of the invention.
Figure 9B:
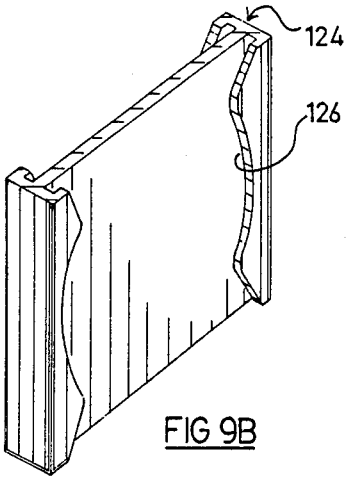
Figure 9C:
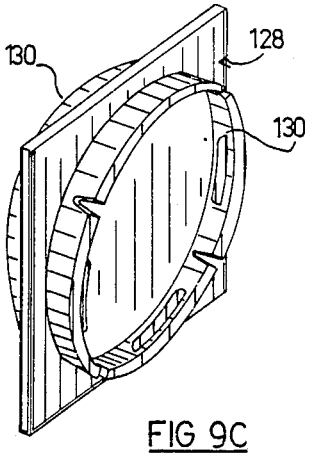

FIGS. 9A–9E illustrate a collection of stand-alone coupling elements. In FIG. 9A, a coupling element 120 having a pair of back-to-back straight walled sockets 122 is shown. FIG. 9B illustrates a similar coupling element 124 having at least one curved wall socket 126. FIG. 9C illustrates a stand-alone coupling element 128 having a pair of back-to-back protruding ring female sockets 130.

Figure 9D:
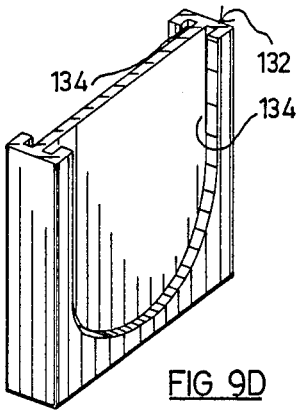
Figure 9E:
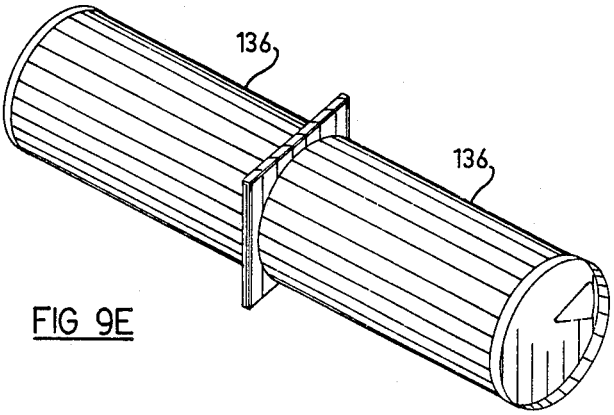
FIG. 9E illustrates axial coupling of two drink cans using a coupling device of the type shown in FIGS. 9A–9D.

FIG. 9D shows a stand-alone coupling element 132 having a pair of back-to-back single outlet sockets 134. FIG. 9E illustrates axial engagement of two cylindrical drink cans 136 using any of the couplings of FIGS. 9A–9D.

Figure 10A:
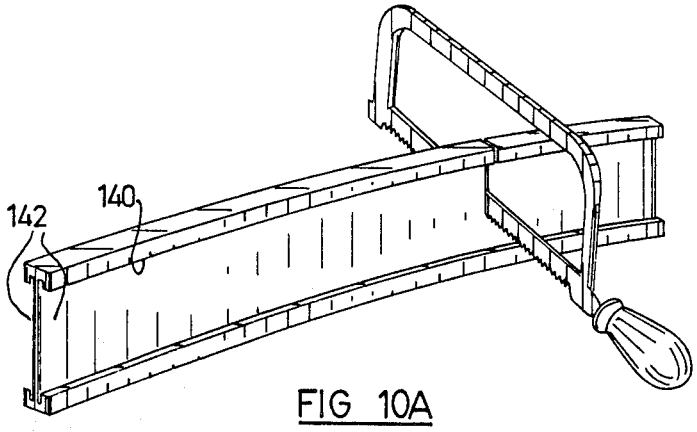
Figure 10B:
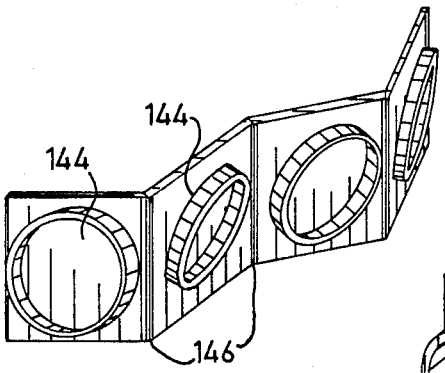

FIGS. 10A–10F are pictorial illustrations of coupling devices having inherent flexibility. FIG. 10A shows an extruded profiled strip 140 which defines back to back straight edge sockets 142 and which may be cut to any desired length. FIG. 10B illustrates a plurality of integrally formed coupling elements 144 of the type shown in FIG. 9C, which are joined by integrally formed flexible hinges 146.

Figure 10C:
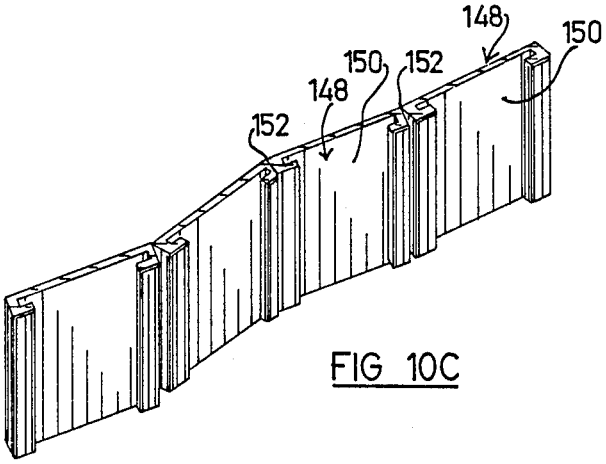

FIG. 10C illustrates a plurality of integrally formed coupling elements 148 having sockets 150 of the type shown in FIG. 9A and which are joined by integrally formed flexible hinges 152.

FIG. 10D illustrates a plurality of integrally formed coupling elements 158 having back-to-back sockets 160 of the type shown in FIG. 9D and which are joined by integrally formed flexible hinges 162.

FIG. 10E shows one arrangement which can be realized using the coupling device of FIG. 10A.

FIG. 10F shows an arrangement of cylindrical drink cans realized with the coupling elements of any of FIGS. 10B, 10C and 10D.

Figure 11A:
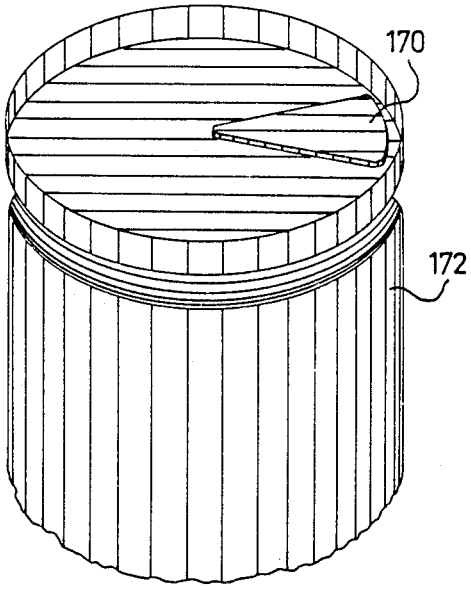
Figure 11E:
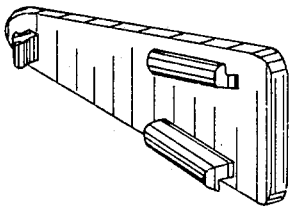
Figure 12A:
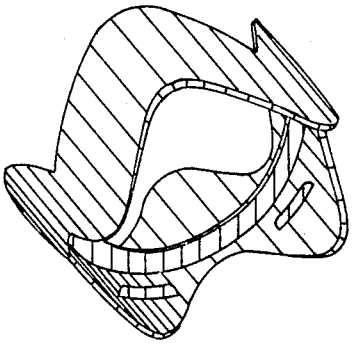
FIGS. 12A, 12B, 12C, 12D and 12E illustrate a plurality of variations of axial coupling elements.
Figure 12B:
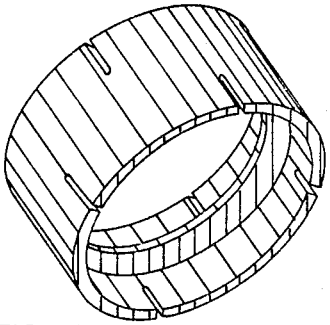
Figure 12D:
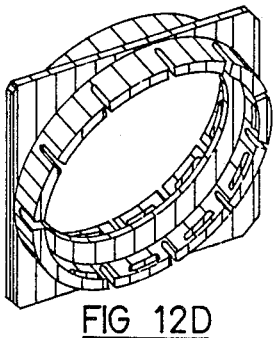

FIG. 11A shows the engagement of a cap member 170 in the opening of a drink can 172 in order to prevent inadvertent injury to a user. FIGS. 11B–11E illustrate a variety of configurations of cap members 170 for snap fit engagement with can 172.

FIGS. 12A–12E illustrate a plurality of variations of end to end axial couplings. The variations in FIGS. 12A–12D are all axial entry and removal friction couplings. The version of FIG. 12E permits side entry and engages the undercut rim on the cylindrical drink can.

Figure 13:
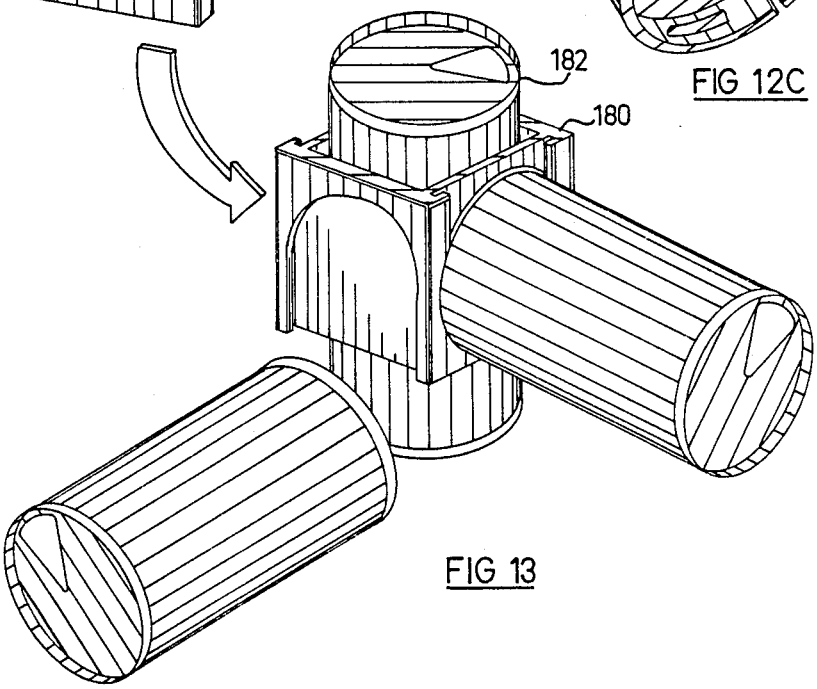
FIG. 13 illustrates connection of a plurality of cylindrical members employing a device according to a further alternative embodiment of the invention.

FIG. 13 illustrates the use of a coupling device 180 of the type shown in FIG. 5E wherein a drink can 182 is located inside the coupling device 180.

Figure 14:
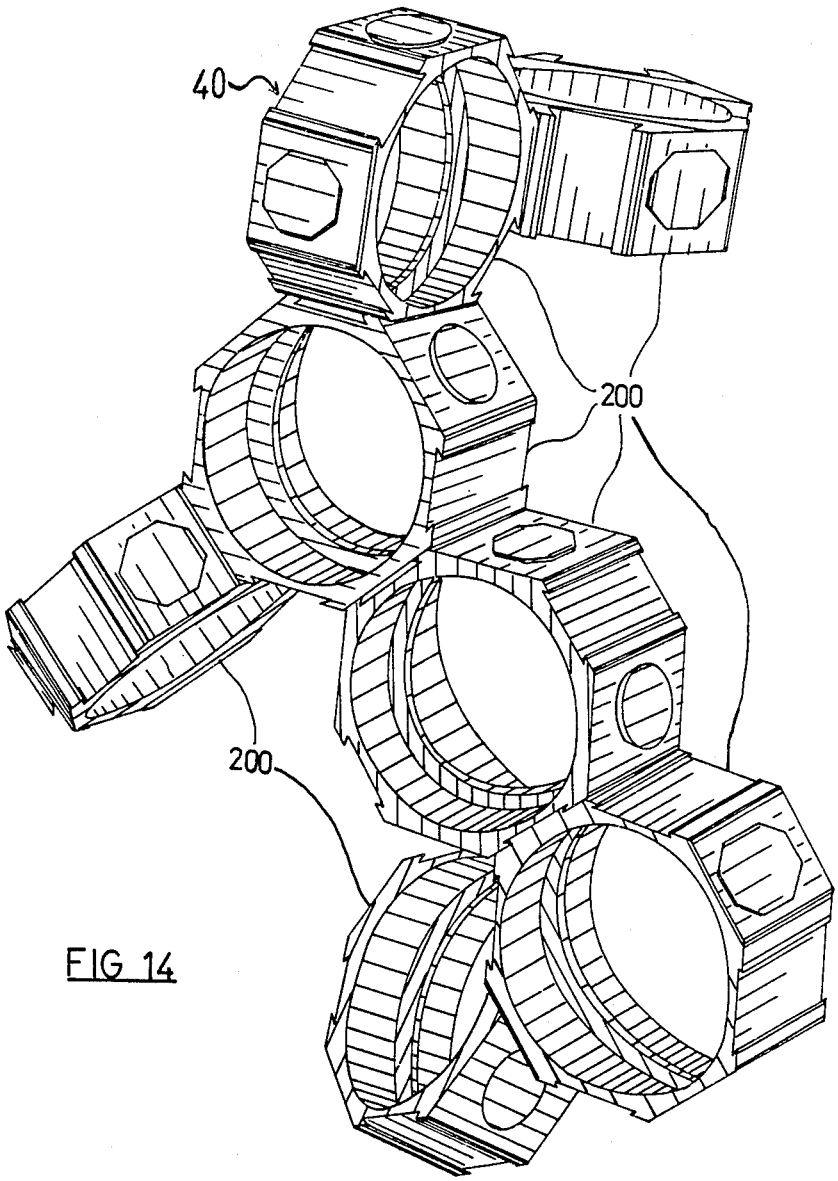
FIGS. 14A, 14B, 14C, 14D, 14E and 14F illustrate a plurality of variations of coupling elements useful in furniture applications.

FIGS. 14A–14F illustrate a variety of coupling devices which can be used to construct furniture. FIG. 14A shows a two can supported span 190 which can be used as an underneath shelf support. FIG. 14B shows a single can supported corner support 192. FIGS. 14C and 14D show two other types of corner supports, 194 and 196, each supported by a single can. FIG. 14E illustrates a shelf end support 198 supported on two cans. FIG. 14F shows a round table support 200.

Figure 15:
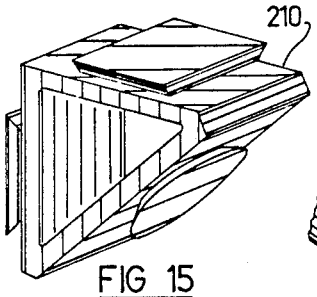
FIG. 15 is a pictorial illustration of an intermediate connector element.
Figure 12E:
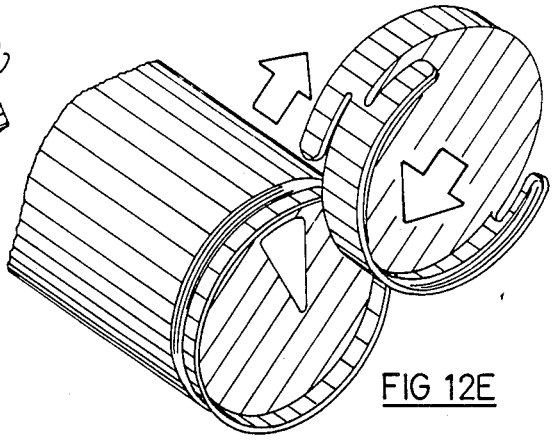
Figure 12C:
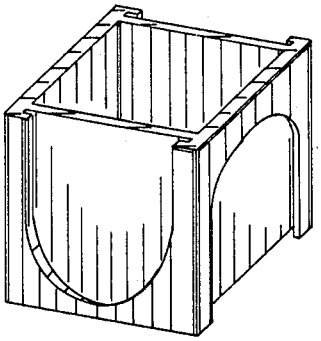
Figure 12C:
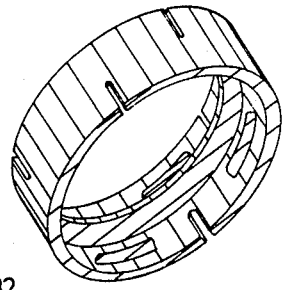

FIG. 15 shows an intermediate connector element 210 having both circular and square protrusions. Element 210 may be used to provide added structural support for constructions employing the devices of FIGS. 1–3.

It will be appreciated by persons skilled in the art that the present invention is not limited to what has been particularly shown and described hereinabove. Rather the scope of the present invention is defined only by the claims which follow:

We claim:

1. An assembly toy comprising:

a plurality of devices for removably connecting a plurality of cylindrical objects, each device including means for coupling to a cylindrical object, each cylindrical object having a longitudinal axis, and means for removably coupling each device to another such device and wherein said means for removably coupling comprises a first engagement element and second and third engagement elements, said second engagement element being arranged for rotatable locking engagement with a first engagement element on another such device, said rotatable locking being with respect to a rotation axis which is perpendicular to the longitudinal axes of adjacent cylindrical objects, and said third engagement element being arranged for non-rotatable locking engagement with a first engagement element on another such device in any one of a plurality of predetermined angular relationships with respect to adjacent longitudinal axes.

2. An assembly toy according to claim 1 and wherein said means for removably coupling comprises snap fitting means.

3. An assembly toy according to claim 1 and wherein said means for removably coupling provides orientation of the cylindrical objects in predetermined relative axial orientations.

4. An assembly toy according to claim 1 and wherein said means for removably coupling provides orientation of the cylindrical objects in selectable relative axial orientations.

5. An assembly toy according to claim 1 and comprising means for providing axial friction fit engagement with the cylindrical elements.

6. An assembly toy according to claim 1 and comprising means for providing snap fit engagement with the cylindrical elements.

7. An assembly toy according to claim 1 and wherein said first engagement element comprises a universal socket, said second engagement element comprises a circular protrusion engageable with said universal socket in a free-azimuth coupling and said third engagement element comprises a non-circular protrusion engageable with said universal socket in a fixed-azimuth coupling.

* * * * *